United States Patent [19]

Mollman

[11] 4,307,927

[45] Dec. 29, 1981

[54] POLARIZATION KEY FOR ELECTRICAL CONNECTOR

[75] Inventor: Walter G. Mollman, Cedar Rapids, Iowa

[73] Assignee: Rockwell International Corporation, El Segundo, Calif.

[21] Appl. No.: 133,381

[22] Filed: Mar. 24, 1980

[51] Int. Cl.[3] ..... H01R 13/64
[52] U.S. Cl. ..... 339/186 M
[58] Field of Search ..... 339/184, 186

[56] References Cited

U.S. PATENT DOCUMENTS 3,474,395 10/1969 Ferdon et al. ..... 339/186 M
3,566,340 2/1971 Jayne et al. ..... 339/186 M

FOREIGN PATENT DOCUMENTS 869319 5/1961 United Kingdom ..... 339/186 M

*Primary Examiner*—Joseph H. McGlynn
*Attorney, Agent, or Firm*—V. Lawrence Sewell; Howard R. Greenberg; H. Fredrick Hamann

[57] ABSTRACT

A polarization key is disclosed for installation in an electrical connector on a backplane circuit board. The key has a tongue portion for insertion into the connector, engaging the resiliently biased contacts of the connector. A tab portion of the key projects outwardly from the connector to prevent the insertion of another circuit board therein unless the other circuit board is properly slotted to mate with the key. A pair of legs extend from the tab portion of the key along the outside of the connector to enter holes provided in the backplane circuit board.

10 Claims, 3 Drawing Figures

POLARIZATION KEY FOR ELECTRICAL CONNECTOR

BACKGROUND OF THE INVENTION

This invention relates to a polarization key for use with an electrical connector such as a circuit board edge connector.

In a typical electronic assembly, a number of circuit boards containing various circuits each plug into a separate multi-contact connector mounted on a backplane board. The backplane board interconnects the multi-contact connectors and thereby interconnects the circuit boards plugged into the connectors. It has been found to be useful in such an arrangement to use polarization keys which prevent a circuit board from being plugged into the wrong backplane connector by mistake. Such a polarization key is fitted at a selected location among the multiple contacts of a connector so that it will coincide with a gap or slot at the edge of the proper circuit board upon insertion. If the wrong circuit board is presented to the backplane connector, the key and gap will not coincide, thereby preventing the circuit board from being inserted.

One problem with a polarization key is the method of fastening it into the backplane connector, namely soldering the key to contacts of the connector. This is a procedure requiring some care. Moreover, if the key is ever to be moved, the contacts to which it was soldered are unfit for ordinary connector use.

Some conventional polarization keys have the drawback that they occupy more than one pair of backplane contacts, thereby eliminating additional contacts from electrical connector operation. It is an additional disadvantage of some conventional polarization keys that they are fabricated of plastic and are thereby too fragile for the use intended.

An additional disadvantage of conventional polarization keys arises from the particular environment in which they are used. For example, if it is desired to insert a circuit card into a backplane connector between two large circuit cards already installed, then the backplane connector may be virtually hidden from view before the insertion and completely hidden during the insertion. As a result, the insertion is carried out by feel. Conventional index keys often produce the result that the circuit card being inserted is blocked at a very small distance before the connector pads of the card engage the contacts of the backplane connector. In this circumstance, the person inserting the card may assume that he is encountering merely the insertion resistance of the mating connectors. Accordingly, he may push hard on the card being inserted and break the key or damage one or both of the connectors.

SUMMARY OF THE INVENTION

In accordance with the present invention, there is provided a polarization key having a tongue portion for insertion into a backplane circuit board connector, engaging the resiliently biased contacts of the connector. A tab portion of the key projects outwardly from the backplane connector toward a circuit board being inserted in the connector. A pair of legs on the key extend from the tab portion along the outside of the backplane connector toward holes provided in the backplane board. The polarization key can be fastened to the backplane board by means of the legs of the key. In addition, the tongue portion of the key has a narrowed part which receives the backplane connector contacts resiliently seated against the tongue portion, providing an additional means of holding the key in place.

In a preferred embodiment, the legs of the polarization key are of different lengths for convenient installation in the holes in the backplane board. Also in a preferred embodiment, the tab portion of the key is constructed to project significantly outwardly from the backplane connector.

The polarization key of the present invention has several advantages. The means of fastening the key to the backplane circuit board connector require the key to occupy only one pair of contacts in that connector. Moreover, there is no necessity to solder the key to those contacts, since it is held in the grip of those contacts and is preferably fastened by its legs to the backplane circuit board. This avoids the awkward fabrication problems of the prior art and minimizes any problems associated with changing the position of the polarization key at some future time.

The polarization key of the invention can be suitably fabricated from metal and when fastened by the legs to the backplane board provides a very durable key structure for long term use. In addition, the key is made to project a significant distance from the backplane connector so as to give a clear and early warning if the wrong circuit board is being inserted into the connector. In order to make this large projection, the key must have the durable construction and means for a strong connection to the backplane connector and board.

DESCRIPTION OF A PREFERRED EMBODIMENT

Figure 1:
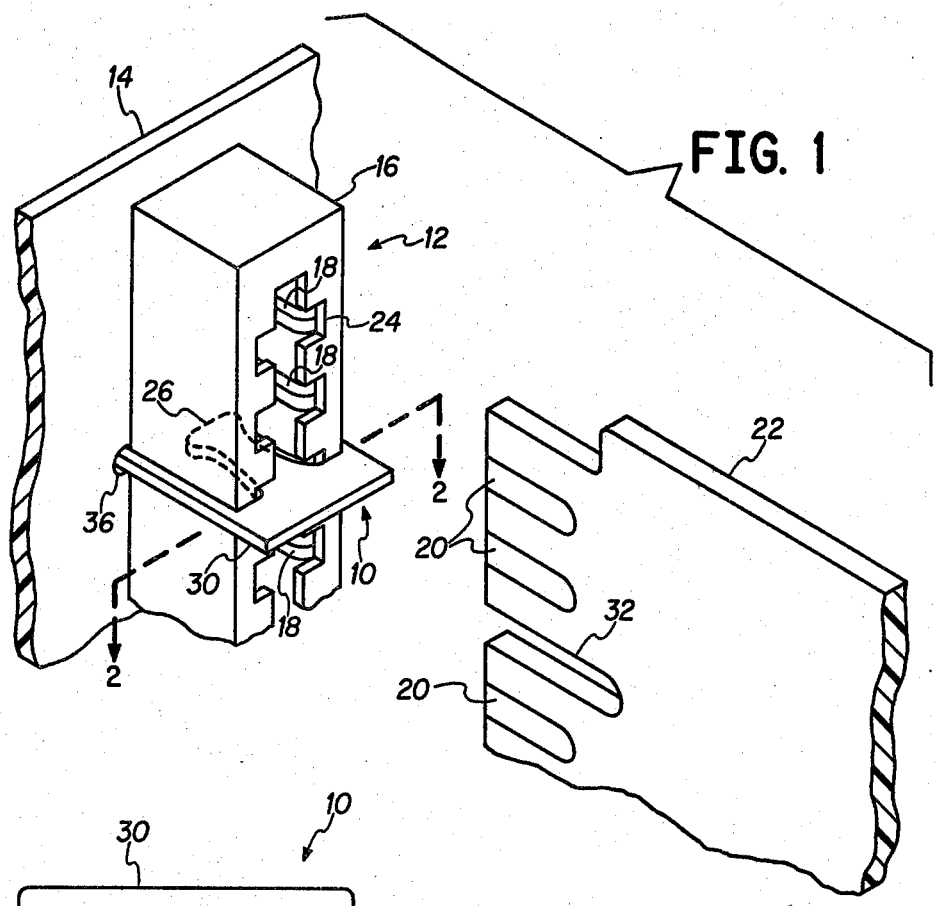
FIG. 1 is a perspective view of a polarization key according to the invention installed in a backplane connector and accompanied by a circuit board to be inserted in the connector.
Figure 2:
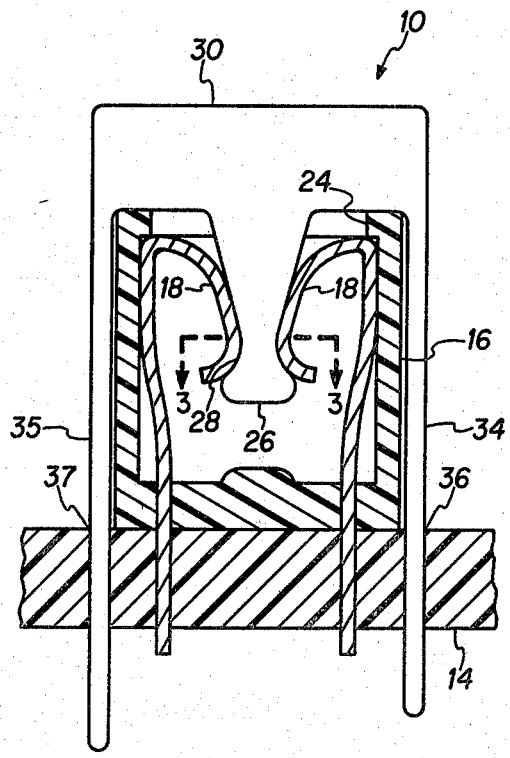
FIG. 2 is a sectional view taken along the line 2—2 in FIG. 1.

In FIGS. 1 and 2, there is illustrated a polarization key in accordance with the invention, indicated generally by the reference numeral 10. The key is inserted in an electrical connector 12 on a backplane circuit board 14.

The connector 12 has a housing 16 including pairs of resiliently biased contacts 18. The contacts are conventionally constructed to engage connector pads 20 on opposite surfaces of a circuit board 22 to be inserted into backplane connector 12 through an opening 24 in the housing 16.

The tab 10 includes a tongue portion 26 for insertion through opening 24 to a position between contacts 18. The contacts are resiliently biased toward each other, so that in conventional use they will bear against the connector pads 20 of the inserted circuit board 22. With the polarization key 10 in place, contacts 18 bear against tongue portion 26 of the key. The tongue portion has a narrowed part 28 which receives contacts 18 so as to exercise a restraint on removal of the key 10 from between the contacts.

A tab portion 30 of the key extends across opening 24, projecting outwardly from the housing 16 and opening 24. When the proper circuit board 22 is being inserted into connector 12, a slot 32 in the inserted board aligns with tab portion 30 allowing full insertion of the board 22. A board not having a slot in the contact position corresponding to the location of key 10 will hit the tab portion 30 of the key and will not be capable of insertion into connector 12.

Tab portion 30 should extend a significant distance outwardly from housing 16 and opening 24 so as to provide a marked indication when the wrong circuit board is being inserted. It has been found that a projection of $\frac{1}{8}$ of an inch gives such an indication.

If the tab portion 30 is to be of such an extent, the polarization key 10 must be fabricated and installed in a particularly durable way. One factor in the structural stability of the installed polarization key 10 is the presence of legs 34 and 35 extending from tab portion 30 to backplane board 14. In the fabrication of backplane board 14, there can be provided holes 36 and 37 through which legs 34 and 35 can project. The section view of FIG. 2 makes it appear that the holes 36 and 37 are completely snug against the legs 34 and 35. In a practical application, however, this is not necessary and it may increase the difficulty of installing the key.

It has been conceived that installation of the key can be made more convenient by making one of the legs, say, leg 35, longer than the other. This permits insertion of the tip of the longer leg 35 into its hole 37, before and independently of aligning leg 34 with its hole 36.

Once the legs 34 and 35 have been inserted in holes 36 and 37, they can be fastened to backplane board 14 by various methods. Depending upon the material from which polarization key 10 is made, the legs can be soldered in place, clinched or bent. It may be appropriate in a particular case to simply snip off the tips of legs 34 and 35 and depend on the restraining force of contacts 18 against the tongue portion 26 of the polarization key. This will, of course, not provide the same level of durability as fastening legs 34 and 35 to backplane board 14.

For maximum durability, the polarization key 10 is preferably fabricated from metal. This also provides the opportunity to solder the legs into place against backplane board 14. If the key is made of plastic, then the legs must fasten by some other method such as clinching.

Figure 3:
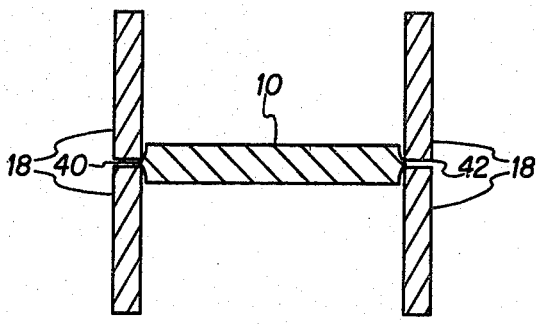
FIG. 3 is a sectional view taken along the line 3—3 in FIG. 2.

Various methods can be used to fabricate a polarization key according to the invention. In particular, if the key is of metal, it can be stamped. Alternatively, it can be etched or chemically milled. In chemical milling, a useful edge is produced between the principal surfaces of the sheet metal. This is illustrated in FIG. 3, as edge 40. Many backplane connectors have a slit 42 between portions of the contacts 18. For these connectors, edge 40 meets with groove 42 to provide an additional centering and positioning constraint on polarization key 10.

I claim:

1. A polarization key for use with an electrical connector of the type having a housing containing a pair of contacts, said housing having an opening therein permitting access to the contacts, said contacts being oppositely disposed near each other and resiliently biased so as to bear against pads of an edge connector of an inserted circuit board, and said housing being mounted against another circuit board, said polarization key comprising:

a tongue portion for insertion through said opening to a position between and engaging the resiliently biased contacts, a tab portion to project outwardly from said housing and said opening and extend across that part of said opening adjacent said contacts, and a pair of legs to extend from the tab portion, along the outside of the housing, toward said another circuit board.

2. The polarization key of claim 1, wherein said tongue portion has a narrowed part for receiving said contacts resiliently seated thereagainst to exert a restraint on removal of the polarization key tongue portion from between the contacts.

3. The polarization key of claim 1, wherein said tab portion projects at least $\frac{1}{8}$ inch outwardly from said housing.

4. The polarization key of claim 1, wherein said tongue portion, tab portion and legs are formed of a metal.

5. The polarization key of claim 1, wherein said tongue portion, tab portion and legs are formed of metal and said tongue portion includes at least one surface disposed for said engaging of one of said contacts, said surface having an edge projecting therefrom to bear against said one contact.

6. The polarization key of claim 1, wherein said index key is to be used with said another circuit board having a pair of holes formed therein adjacent said housing and on opposite sides thereof, wherein each of said legs is sufficiently long to extend into a different one of said holes.

7. The polarization key of claim 6, wherein said legs are of different lengths.

8. A polarization key for use with an electrical connector of the type having a housing containing a pair of contacts, said housing having an opening therein permitting access to the contacts, said contacts being oppositely disposed near each other and resiliently biased so as to bear against pads of an edge connector of an inserted circuit board, and said housing being mounted against another circuit board having a pair of holes formed therein adjacent said housing and on opposite sides thereof, said polarization key comprising:

a tongue portion for insertion through said opening to a position between the contacts, said tongue portion having a narrowed part for receiving said contacts resiliently seated thereagainst to exert a restraint on removal of the polarization key tongue portion from between the contacts;

a tab portion to project outwardly from said housing and said opening and extend across that part of said opening adjacent said contacts; and a pair of legs of different lengths to extend from the tab portion, along the outside of the housing, into said holes in said another circuit board.

9. The polarization key of claim 8, wherein said tongue portion, tab portion and legs are formed of metal.

10. The polarization key of claim 8, wherein said tab portion projects at least $\frac{1}{8}$ inch outwardly from said housing.

* * * * *